US005566242A

United States Patent [19]

Hall

[11] Patent Number: 5,566,242

[45] Date of Patent: Oct. 15, 1996

[54] MECHANISM FOR A SPEAKER ASSEMBLY

[75] Inventor: David Hall, San Jose, Calif.

[73] Assignee: Velodyne Acoustics, Inc., San Jose, Calif.

[21] Appl. No.: 284,804

[22] Filed: Aug. 2, 1994

[51] Int. Cl.[6] ..... H04R 25/00

[52] U.S. Cl. ..... 381/202; 381/188; 381/189; 381/205; 181/148; 181/150

[58] Field of Search ..... 381/202, 193–4, 381/188, 189, 199, 152, 205, 124; 181/148, 150, 153, 154, 198, 199; D14/214, 215, 216

[56] References Cited

U.S. PATENT DOCUMENTS

| | | | |
|---|---|---|---|
| 2,611,803 | 9/1952 | Heineman | 381/193 |
| 3,240,882 | 3/1966 | Eichler | 179/115.5 |
| 3,660,618 | 5/1972 | White | 179/115.5 |
| 3,924,083 | 12/1975 | Hagey | 179/149 |
| 4,205,205 | 5/1980 | Babb | 381/194 |
| 4,395,598 | 7/1983 | Lesage | 179/115.5 |
| 4,451,928 | 5/1984 | Murayama | 381/86 |
| 4,591,672 | 5/1986 | Kato et al. | 381/194 |
| 4,633,972 | 1/1987 | DeRocher | 381/188 |
| 4,903,308 | 2/1990 | Paddock et al. | 381/202 |
| 5,243,151 | 9/1993 | Prokisch | 381/188 |

FOREIGN PATENT DOCUMENTS

| | | | |
|---|---|---|---|
| 62-147900 | 1/1987 | Japan | 381/199 |

*Primary Examiner*—Forester W. Isen
*Assistant Examiner*—Xu Mei
*Attorney, Agent, or Firm*—Bielen, Peterson & Lampe

[57] ABSTRACT

A mechanism for a speaker assembly utilizing a brace for confining a speaker cone in a particular orientation. The brace is provided with at least first and second feet which append therefrom. At least one of the feet is fastened to a permanent magnet associated with the cone to isolate vibrations originating in the permanent magnet. In this regard, a plate is employed in conjunction with an elastomeric member such that the elastomeric member is interposed the foot and the plate. The elastomeric member is held to the plate and the first foot. The elastomeric member is sized to create a bias for movement of the brace only in a shear direction relative to the plate and the first foot. A fastener is also employed to support the first and second feet to the permanent magnet at predetermined distances from the permanent magnet.

10 Claims, 2 Drawing Sheets

MECHANISM FOR A SPEAKER ASSEMBLY

BACKGROUND OF THE INVENTION

In accordance with the present invention a novel and useful mechanism for a speaker assembly is herein provided.

Speaker systems in the past have always been susceptible to stray vibrations when mounted in an enclosure. Such stray vibrations adversely affect the sound emanating from a speaker and are to be avoided whenever possible. In this regard, speaker systems have been constructed with flexible spiders and elastomeric shims to prevent vibrations from occurring. Such design expedients have been of limited value in reducing vibrations from a speaker mounted to an enclosure.

For example, U.S. Pat. No. 3,240,882 shows a flexible corrugated spider which is utilized to center the voice coil of a speaker. U.S. Pat. Nos. 3,660,618 and 4,633,972 describe retaining devices which use elastomeric materials used in conjunction with the mounting of a speaker.

U.S. Pat. No. 4,903,308 describes an audio transducer having controlled flexibility through a diaphragm and elastomeric cords.

U.S. Pat. No. 4,451,928 teaches a speaker system for automobiles in which elastomeric body is employed to pivotally hold a supporting plug.

U.S. Pat. No. 3,924,083 indicates an adaptor for a microphone which employs a block and cup made from elastic material which holds a shaft connected to the support stand for the microphone.

U.S. Pat. No. 4,395,598 illustrates an elastic suspension and an elastomeric layer that are formed in the central region at the rear of the speaker system.

A support mechanism for a speaker assembly which directly connects the speaker cone to the permanent magnet structure of a speaker system with the elimination of vibration when mounting the speaker in an enclosure would be a notable advance in the acoustic arts.

SUMMARY OF THE INVENTION

In accordance with the present invention a novel and useful mechanism for a speaker assembly is herein provided.

The speaker assembly employed with the present invention includes a speaker cone which is linked to a permanent magnet at the rear portion of the speaker cone. The assembly including the mechanism of the present invention is intended for use with a speaker enclosure. The mechanism of the present invention for mounting such speaker to the permanent magnet includes a brace which confines the speaker cone in an outwardly facing orientation. The brace may include a pair of legs or any multiplicity of legs which append therefrom either in a unitary fashion or through a conventional connection mechanism. The brace and appending legs form a basket like structure which engages the speaker cone and aligns the same with the voice coil former and voice coil that are normally found behind the speaker cone. Each of the feet appending from the brace may include a pad which extends inwardly toward the voice coil former located on the central axis of the cone. The brace may be formed of any rigid or semi-rigid material such as metal, wood, plastic, and the like.

The mechanism of the present invention also embodies fastening means for supporting one or more of the brace feet to the permanent magnet which is located adjacent and behind the speaker cone. Such fastening means serves to isolate any vibration originating in the permanent magnet from transferring to the speaker enclosure. An exemplar foot would be connected to the permanent magnet employing a plate and a flattened elastomeric member interposed the exemplar foot and the plate. Preferably, the elastomeric member would be connected to the pad of the foot and be sized and formed to create a bias for movement of the brace in a shear direction relative to the plate. Thus, the speaker cone is not permitted to move substantially off the speaker central axis aligned with the voice coil former and the voice coil surrounding the same. The elastomeric member is supported to the plate and the first foot by holding means which may take the form of a mastic material or other suitable bonding means. That is to say, mastic layers would be formed on either side of the elastomeric member to connect the same to the adjacent plate and foot of the brace.

A fastener is also included in the present invention to support at least the first and second feet of the brace to the permanent magnet, each at a predetermined distance. Such fastener may take the form of a mechanical holder such as a screw or bolt, but preferably consists of a glue-like material spanning each permanent magnet and each foot possessing a plate. In essence, the fasteners utilized to support the first and second feet to the permanent magnet overcome any unsymmetrical formation of the permanent magnet, which is not an uncommon characteristic.

The present mechanism also may be constructed with stop means for limiting the shear movement of any of the feet and connected elastomeric member relative to the plate. Such stop means may externalize in the plate being formed with a rim that at least partially surrounds the elastomeric member and the portion of the foot connected thereto. In this regard, a pad may be interposed to cushion the foot against contact with the rim of the plate. In many instances, the pad may be formed into a loop of resilient material which lies on the pad connected to the foot or the foot terminus.

It may be apparent that a novel and useful mechanism for a speaker assembly is herein provided.

It is therefore an object of the present invention to provide a mechanism for a speaker assembly that mounts a speaker cone to a permanent magnet and permits the speaker cone to be aligned with the voice coil and voice coil former, despite the employment of an unsymmetrical permanent magnet thereabout.

Another object of the present invention is to provide a mechanism for a speaker assembly that precludes, to a large degree, any transverse movement of the speaker cone relative to the permanent magnet and limits movement of the speaker cone in a direction along the central axis of the cone.

Yet another object of the present invention is to provide mechanism for a speaker assembly which do not obstruct sound generated by the speaker cone and does not aesthetically obscure the face of the speaker cone.

Yet another object of the present invention is to provide a mechanism for a speaker assembly which eliminates unwanted vibration to a speaker enclosure due to vibration of the magnet when the speaker cone and connected permanent magnet is placed in such cabinet or enclosure for use.

The invention possesses other objects and advantages especially as concerns particular characteristics and features thereof which will become apparent as the specification continues.

For a better understanding of the invention, references made to the following detailed description of the preferred embodiments thereof which should be referenced to the prior described drawings.

DETAILED DESCRIPTION OF THE PREFERRED EMBODIMENTS

Various aspects of the present invention will evolve from the following detailed description of the preferred embodiments which should be taken conjunction with the prior described drawings.

Figure 1:
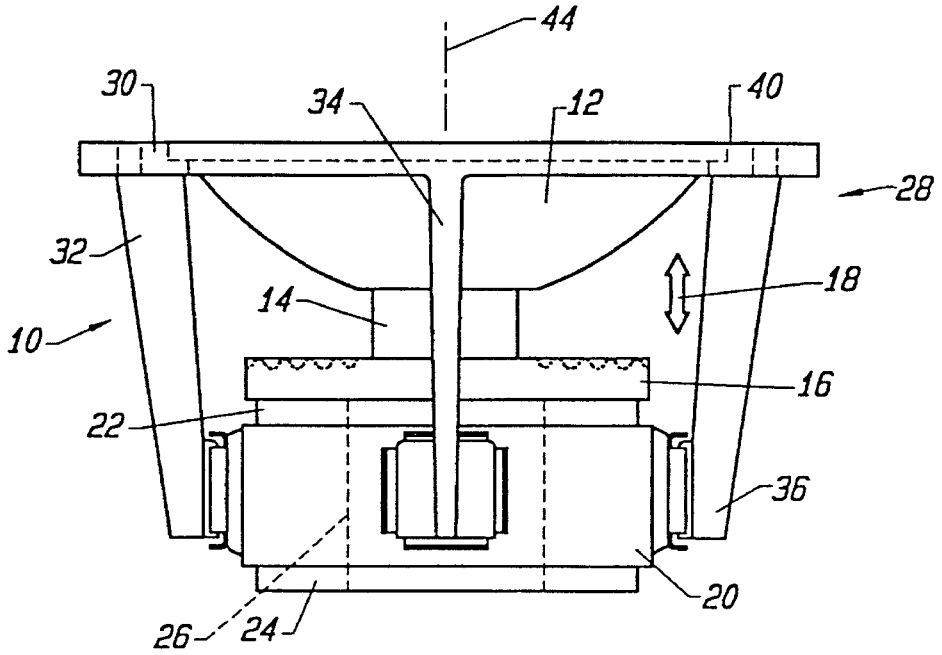
FIG. 1 is side elevational view of the mechanism of the present invention.

The invention as a whole is depicted in the drawings by reference character 10. Mechanism 10 is intended, in part, to support a speaker cone 12 which is depicted in FIG. 1 as a concave contiguous dish. Cone 12 is connected to and extends from a voice coil former 14. A spider 16, of conventional configuration, supports former 14 and connected speaker cone 12 to allow speaker cone 12 to vibrate upwardly and downward according to directional arrow 18. Former 14 extends into a permanent magnet 20 sandwiched by plates or pole pieces 22 and 24. Voice coils normally wrapped about former 14 are usually found within cavity 26 formed within permanent magnet 20 and pole pieces 22 and 24. Such voice coils are not depicted in the drawings for the sake of simplicity.

Figure 2:
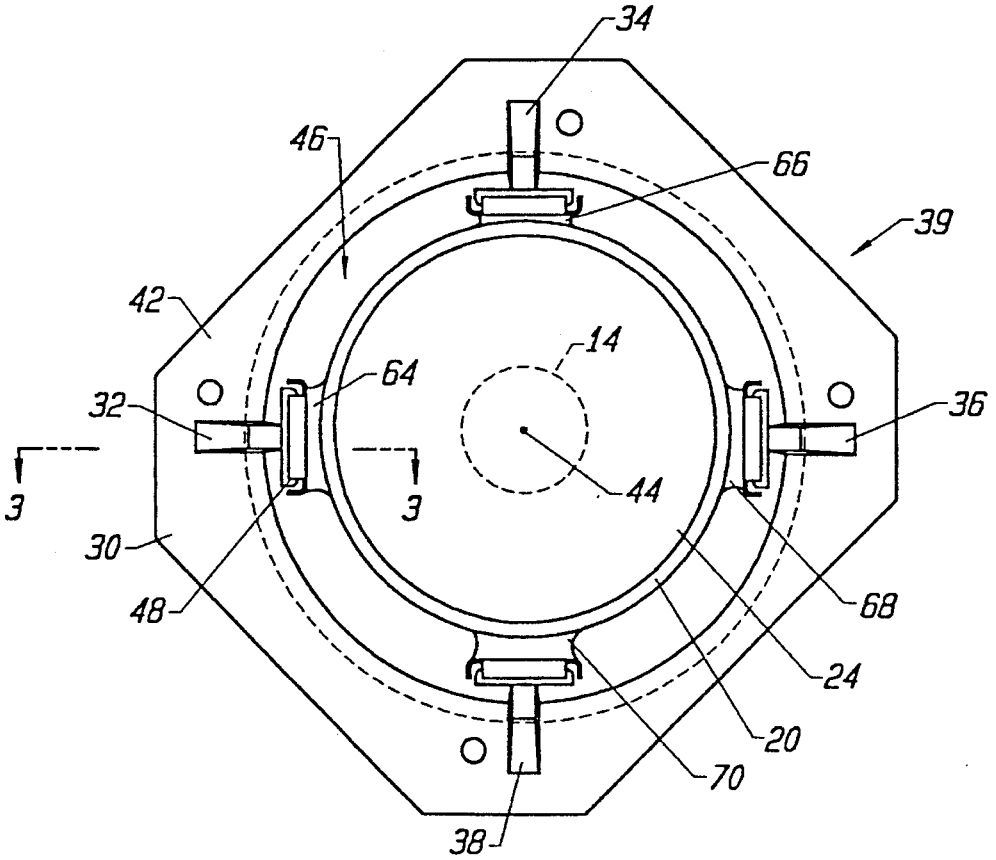
FIG. 2 is a bottom plan view of the support mechanism of the present invention.

Mechanism 10 includes as one of its elements a brace 28 constructed as a basket 30 and depending feet 32, 34, 36, and 38. Plurality of openings 39 permit brace 28 and attached components, such cone 12 and permanent magnet 20 to be attached to a speaker enclosure (not shown). Basket 30 is in the shape of an irregular octagon and includes an upper surface 40 and a lower surface 42. Basket 30 and feet 32, 34, 36, and 38 may be constructed as a unitary member or as separated items to be assembled into a unitary member as depicted in FIGS. 1 and 2. It should be noted that speaker cone 12 includes a central axis 44 along which speaker 12 moves according to directional arrow 18. It is important that speaker central axis 44 lie congruently with the axis of former 14, FIG. 2.

Figure 3:
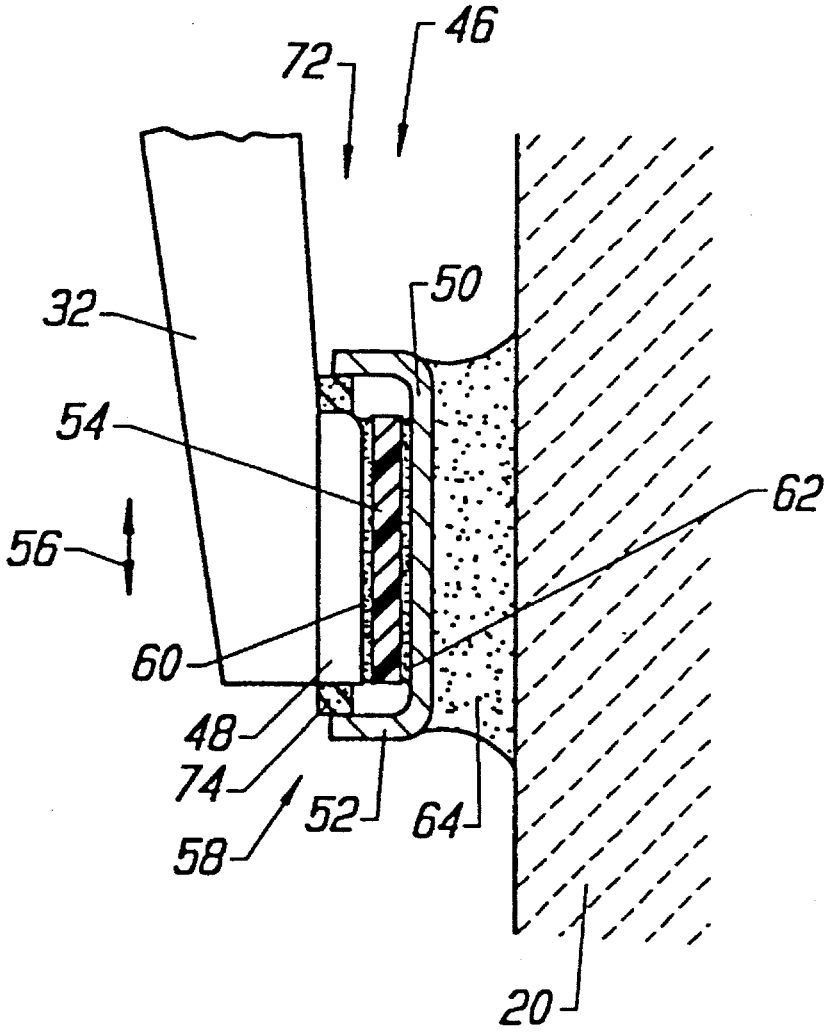
FIG. 3 is a sectional view taken along line 3—3 of FIG. 2.

To achieve the alignment of cone 12 with former 14, fastening means 46 is provided in the present mechanism 10. Fastening means 46 is employed to support at least a pair of feet 32, 34, 36, and 38 of brace 28 to permanent magnet 20. Fastening means 46 may be employed with at least feet 32 and 36 as depicted in FIGS. 1 and 2. As may be observed in FIG. 3, foot 32 is depicted as exemplary of fastening means 46. Foot 32 depending from a basket 30 terminates in a rigid pad 48 which is integrally formed or connected to foot 32. A plate 50 is also utilized in fastening means 46. Plate 50 is formed into a cup having a rim portion 52. Elastomeric member 54 interposes foot 32 and plate 50. It should be noted that elastomeric member 54 is a flattened element which is not substantially compressible or moveable transversely relative to axis 44 of speaker cone 12. However, elastomeric member does permit movement along directional arrow 56 which is generally along axis 44 of speaker cone 12. In other words, elastomeric member 54 biases the movement of speaker 12, brace 28, and leg 32 relative to permanent magnet 20 in a shear direction which generally coincides with axis 44 of speaker cone 12.

Holding means 58 is also depicted in the drawings for supporting elastomeric member 54 to plate 50 and foot 32. Holding means 58 takes the form of mastic layers 60 and 62 which link pad 48 and plate 50 to elastomeric member 54, respectively. Of course, other methods may be employed to connect elastomeric member to foot 32 and plate 50.

Fastener 64, in the form of a mass or body of glue, supports foot 32 to permanent magnet 20 through connected plate 50. It should be noted that fasteners 66, 68, and 70 are employed with respect to feet 34, 36, and 38, respectively, FIG. 2. Each fastener 64, 66, 68, and 70 fix the associated foot a particular distance from the permanent magnet 20 in order to align speaker cone 12 with axis 44 along former 14. Permanent magnet 20 is often asymmetrically or eccentrically formed, requiring such an adjustment. For example, FIG. 2 shows fastener 66 as being shorter than fastener 70.

Stop means 72 is also found in the present invention to limit the movement of exemplar foot 32 relative to permanent magnet 20 along directional arrow 56. Stop means 72 externalizes in a pad 48 contacting rim portion 52 of plate 50. Resilient spacer 74 is placed at the periphery of pad 48 and may form an endless loop thereabout. Thus, pad 48 does not directly contact rim 52 during movement along directional arrow 56. It should be noted the description with respect to exemplar foot 32 also applies to at least foot 36 and, in the embodiment shown in the drawings, to feet 34 and 38 depending from basket 30.

In operation, speaker cone 12 is mounted on former 14 and connected to spider 16. Spider 16 is itself fastened to pole piece 22. Pole pieces 22 and 24 sandwich permanent magnet 20 together and are generally connected thereto. Basket 30 of base 28 is centered along axis 44 of speaker cone 12 and former 14 such that depending legs or feet 32, 34, 36, and 38 extend downwardly to the vicinity of permanent magnet 20. Fastening means 46 may be employed to connect each of the feet 32, 34, 36, and 38 to permanent magnet 20 which isolates any vibration originating at permanent magnet 20. In particular, fasteners 64 of varying sizes may be employed to achieve the alignment of speaker cone 12 with former 14 along axis 44 in an efficient and accurate manner. Any vibration generated or applied to speaker cone 12 results in movement of speaker cone 12 along directional arrow 18. Vibrations originating with permanent magnet 20 are isolated from a speaker enclosure employed with mechanism 10.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A mechanism for mounting a speaker cone to a permanent magnet adjacent the speaker cone comprising:

a. a brace for confining the speaker cone, said brace including at least first and second feet depending therefrom;

b. fastening means for supporting at least said first foot to the permanent magnet, said fastening means including a plate, an elastomeric member interposed said first foot and said plate, said elastomeric member creating a bias for movement of said first foot in a shear direction relative to said plate, holding means for supporting said elastomeric member to said plate and said first foot, and first and second fasteners for supporting each of said first and second feet directly to the permanent magnet at a predetermined distance therefrom.

2. The mechanism of claim 1 in which said brace includes a quartet of feet appending therefrom.

3. The mechanism of claim 1 in which said holding means for supporting said elastomeric member to said plate and said foot includes one mastic layer interposed said elastomeric member and said plate.

4. The mechanism of claim 3 in which said holding means for supporting said elastomeric member to said plate and said first foot further includes another mastic layer interposed said elastomeric member and said plate.

5. The mechanism of claim 1 in which at least said first foot includes a pad positioned adjacent said elastomeric member.

6. The mechanism of claim 1 which additionally includes stop means for limiting the shear movement of said at least first foot and elastomeric member held thereto relative to said plate.

7. The mechanism of claim 6 in which said stop means includes a rim extending outwardly from said plate toward said first foot.

8. The mechanism of claim 7 in which said stop means further includes a resilient spacer interposed said first foot and said rim of said plate.

9. The mechanism of claim 8 in which said first foot includes a pad, said resilient spacer at least partially surrounding said pad and interposed said pad and said rim of said spacer.

10. The mechanism of claim 1 in which said fastening means further supports said second foot to the permanent magnet and where said fastening means plate is a first plate, said elastomeric member is a first elastomeric member said holding means is first a holding means, and said fastener is a first fastener, and further includes a second plate, a second elastomeric member interposed said second foot and said second plate said second elastomeric member creating a bias for movement in a shear direction between said second plate and said second foot, second holding means for supporting said second elastomeric member to said second plate and said second foot, and a second fastener for supporting said second foot to the permanent magnet at a predetermined distance.

* * * * *